US009538624B2

(12) United States Patent
Zhang et al.

(10) Patent No.: US 9,538,624 B2
(45) Date of Patent: Jan. 3, 2017

(54) DISPLAY BACKLIGHT MODULATION

(75) Inventors: Yanli Zhang, San Jose, CA (US); Akihiro Takagi, San Mateo, CA (US); Achintya K. Bhowmik, Cupertino, CA (US); Anil V. Nanduri, San Jose, CA (US)

(73) Assignee: INTEL CORPORATION, Santa Clara, CA (US)

( * ) Notice: Subject to any disclaimer, the term of this patent is extended or adjusted under 35 U.S.C. 154(b) by 199 days.

(21) Appl. No.: 13/997,599

(22) PCT Filed: Dec. 29, 2011

(86) PCT No.: PCT/US2011/067724

§ 371 (c)(1),
(2), (4) Date: Jun. 24, 2013

(87) PCT Pub. No.: WO2013/101021

PCT Pub. Date: Apr. 7, 2013

(65) Prior Publication Data

US 2014/0062329 A1 Mar. 6, 2014

(51) Int. Cl.

| | |
|---|---|
| ***G09F 13/04*** | (2006.01) |
| ***H05B 37/02*** | (2006.01) |
| ***G09G 3/34*** | (2006.01) |

(52) U.S. Cl.

CPC ..... *H05B 37/0281* (2013.01); *G09G 3/342* (2013.01); *G09G 2310/08* (2013.01)

(58) Field of Classification Search

CPC .. G09G 2310/08; G09G 3/342; H05B 37/0281
USPC ..... 315/209, 210
See application file for complete search history.

(56) References Cited

U.S. PATENT DOCUMENTS

| | | | | |
|---|---|---|---|---|
| 2002/0168069 | A1* | 11/2002 | Tehranchi | G06T 1/005 380/235 |
| 2003/0178951 | A1 | 9/2003 | Park et al. | |
| 2005/0063742 | A1* | 3/2005 | Roddy | G03B 17/245 399/311 |
| 2006/0091821 | A1 | 5/2006 | Li et al. | |
| 2007/0057900 | A1* | 3/2007 | Huang | 345/102 |

(Continued)

FOREIGN PATENT DOCUMENTS

| | | | |
|---|---|---|---|
| CN | 1645206 | A | 7/2005 |
| CN | 1991458 | A | 7/2007 |

(Continued)

OTHER PUBLICATIONS

"Notification Concerning Transmittal of International Preliminary Report on Patentability Chapter 1 of the Patent Cooperation Treaty", Jul. 10, 2014, for International Application No. PCT/US2011/067724, 7pgs.

(Continued)

*Primary Examiner* — Peggy Neils
*Assistant Examiner* — Tsion Tumebo
(74) *Attorney, Agent, or Firm* — Buckley, Maschoff & Talwalkar LLC

(57) ABSTRACT

An apparatus may include a backlight for illuminating a liquid crystal display and a control module for controlling the illumination of the backlight. The control module may alternate between turning the backlight on and off at a first frequency and turning the backlight on and off at a second frequency.

26 Claims, 6 Drawing Sheets

(56) References Cited

U.S. PATENT DOCUMENTS

| | | | | |
|---|---|---|---|---|
| 2007/0152951 | A1* | 7/2007 | Ahn | G09G 3/342 345/102 |
| 2007/0176883 | A1* | 8/2007 | Hsu et al. | 345/102 |
| 2007/0257878 | A1* | 11/2007 | Tanaka | G09G 3/3413 345/99 |
| 2009/0122087 | A1* | 5/2009 | Maruyama | G09G 3/3611 345/690 |
| 2009/0158443 | A1* | 6/2009 | Dias | G06F 21/10 726/32 |
| 2010/0020108 | A1* | 1/2010 | Cho | G09G 3/3406 345/690 |
| 2011/0074301 | A1* | 3/2011 | Goder | 315/210 |
| 2011/0243325 | A1* | 10/2011 | Ishii | G06F 3/1431 380/218 |
| 2012/0188293 | A1* | 7/2012 | Furukawa | 345/690 |
| 2013/0050280 | A1* | 2/2013 | Huang | 345/690 |
| 2013/0257827 | A1* | 10/2013 | Hsieh et al. | 345/204 |

FOREIGN PATENT DOCUMENTS

| | | | |
|---|---|---|---|
| CN | 101083055 | A | 12/2007 |
| CN | 101640029 | A | 2/2010 |
| JP | 2003-169273 | A | 6/2003 |
| JP | 2004020975 | A | 1/2004 |
| JP | 2004-259510 | A | 9/2004 |
| JP | 2004259510 | A | 9/2004 |
| JP | 2005-102126 | A | 4/2005 |
| JP | 2008-67356 | A | 3/2008 |
| KR | 20060052338 | A | 5/2006 |
| KR | 20070062016 | A | 6/2007 |
| KR | 20070072340 | A | 7/2007 |
| WO | 2007110975 | A1 | 10/2007 |

OTHER PUBLICATIONS

"Notice of Reasons for Rejection" dated Apr. 14, 2015 from the Japanese Patent Office, along with unofficial English translation, 3 pp.

"PCT Notification of Transmittal of the International Search Report and the Written Opinion of the International Searching Authority, or the Declaration", dated Sep. 18, 2012, for International Application No. PCT/US2011/087624, 10pgs.

"Notice of Reasons for Rejection" dated Aug. 4, 2015 from the Japanese Patent Office, along with unofficial English translation, 4 pages total.

"Second Office Action" dated Jan. 4, 2016 issued by the Chinese State Intellectual Property Office in corresponding CN Application No. 20118007600095, along with unofficial English translation, 24 pages.

* cited by examiner

DISPLAY BACKLIGHT MODULATION

BACKGROUND OF THE INVENTION

The performance of accurate texture detection and analysis is an important task when performing image analysis. Specifically, texture detection and analysis is utilized when detecting motion for use in frame interpolation for frame rate up-conversion, video surveillance, and the like. The performance of such analysis in real or near real time when dealing with video can require substantial computational resources.

There may therefore exist a need to provide a low-complexity solution to identifying texture orientations, particularly those which repeat with an identifiable periodicity.

DETAILED DESCRIPTION OF EXAMPLE EMBODIMENTS

Various displays used for electronic devices may be implemented using backlights. For example, liquid crystal displays (LCD) may require a backlight to function. A backlight in a display provides illumination for the display. Typically, a backlight is positioned behind or to the side of the surface of the display. In LCDs, illumination from the backlight strikes the liquid crystal elements on the surface of the display. The liquid crystal elements, depending on their orientation as controlled by a current, allow varying amounts of the illumination from the backlight to pass through the surface of the display and emanate out, providing the picture on the display.

With recent improvements in picture quality of LCD using backlights, high quality picture content may be easily recorded. For example, feature films and other copyrighted material may easily be recorded from an LCD screen of a computer, television, or other electronic device. The ability to record copyrighted material at high quality causes some concern to film companies and other owners of copyrighted works. As a result, these companies and individuals may be, in some instances and/or under certain circumstances, less likely to allow their content to be displayed on LCD screens.

Figure 1A:
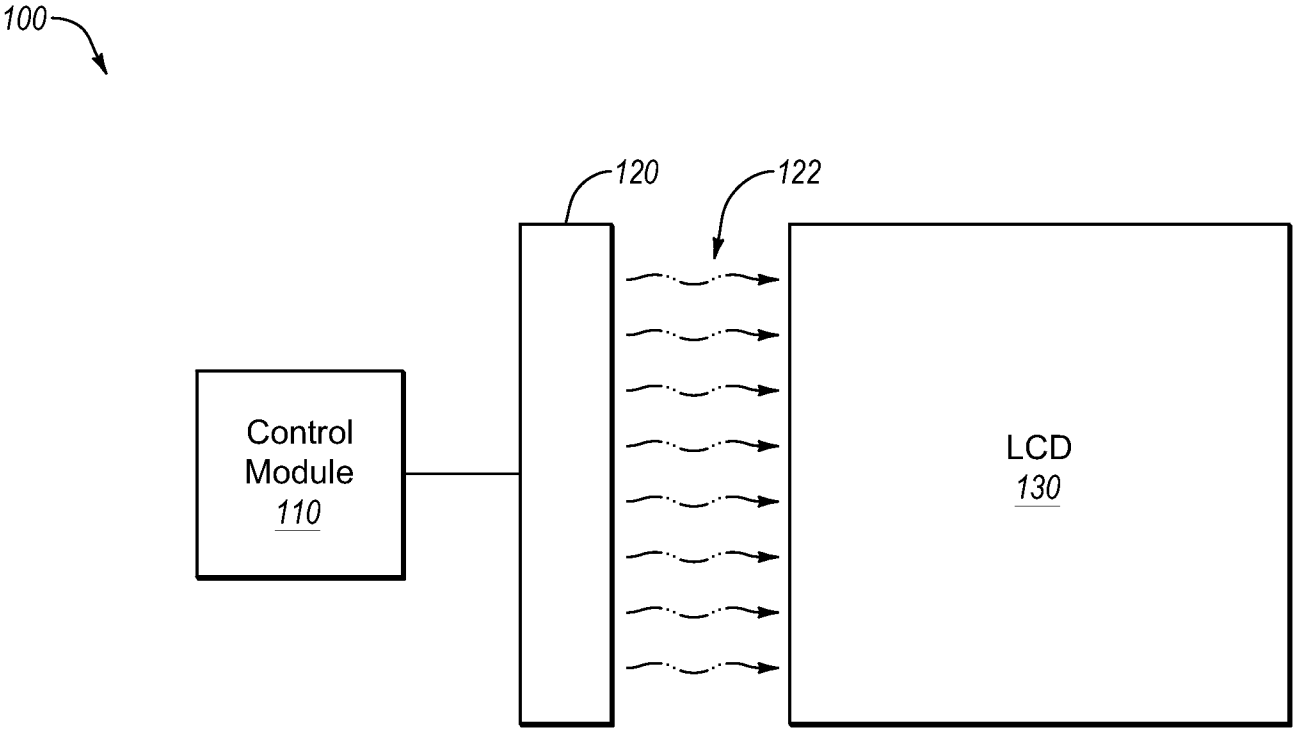
FIG. 1A is a block diagram of an example system 100, according to some embodiments.

FIG. 1A is a block diagram of an example system 100, according to some embodiments. The system 100 includes a control module 110, backlight 120, and a liquid crystal display (LCD) 130. The backlight 120 may be configured to produce illumination 122 that may illuminate the LCD 130. The LCD 130 may manipulate the illumination 122 to form images that emanate out of the LCD 130.

When the LCD 130 manipulates the illumination 122 to form the images, some of the underlying characteristics of the illumination 122 may not be affected by the LCD. For example, in some embodiments, certain modulations of the illumination 122 may not be affected when the illumination 122 passes through the LCD 130. One type of modulation of the illumination 122 that may not be affected is produced by turning the backlight 120 on and off at a frequency to cause the backlight 120 to produce regular flashes of illumination 122 at the frequency.

If the flashes of the illumination 122 are above a certain range of frequencies, the flashes may not be detectable by a human eye. For example, if the frequency of the modulation of the illumination 122 is above approximately 50-60 hertz, a human eye may not be able to detect the modulation. At certain frequencies that are not detectable by the human eye, a recording device, such as a camcorder or camera, used to record images produced by the LCD 130 may, however record the flashes of the illumination 122. For example, in some embodiments, if the LCD 130 is illuminated with the illumination 122 that flashes at a frequency in a range between 60 and 1000 hertz, the flashes may be recorded by a recording device. Thus, by illuminating the LCD 130 with the illumination 122 that flashes at a frequency imperceptible by the human eye but recordable by a recording device, image quality produced by the LCD 130 may be maintained for the human eye while being degraded for the recording device.

In some embodiments, the image quality for recording devices may be degraded because the flashes of the illumination 122 may be displayed as lines or other unwanted artifacts on the recorded image. For example, a camcorder recording a movie displayed on a LCD television screen may have degraded video quality if the illumination 122 flashes because unwanted lines or blurred sections would appear in the recorded images in the video.

In some embodiments, a recording device may be configured to detect and compensate for modulation, such as flashing, of the illumination 122 at a single frequency. In these and other embodiments, however, the recording device may not be able to compensate for modulation of illumination 122 at more than one frequency or changing frequencies.

In the system 100, the control module 110 may be configured to control the illumination 122 of the backlight 120 by turning the backlight 120 on and off at a first frequency. When the backlight 120 is on, the backlight 120 produces the illumination 122. When the backlight 120 is off, the backlight 120 does not produce the illumination 122. Thus, turning the backlight 120 on and off causes a modulation of the illumination 122 produced by the backlight 120. The control module 110 may also be configured to control the illumination 122 of the backlight 120 by turning the backlight 120 on and off at a second frequency to cause a modulation of the illumination 122 produced by the backlight 120 at the second frequency.

In some embodiments, the control module 110 may alternate between turning the backlight 120 on and off at a first frequency and turning the backlight on and off at a second frequency. For example, the control module 110 may turn the backlight 120 on and off at a first frequency for a first period. The control module 110 may then turn the backlight 120 on and off at a second frequency for a second period, followed by the control module 110 turning the backlight 120 on and off at the first frequency for a third period and turning the backlight 120 on and off at the second frequency for a fourth period.

In some embodiments, the durations of the periods that the control module 110 turns the backlight 120 on and off at the first and second frequencies may be substantial equal or unequal. Alternately or additionally, the durations of the periods that the control module 110 turns the backlight 120 on and off at the first and second frequencies may be constant or random. In some embodiments, the durations of the periods that the control module 110 turns the backlight 120 on and off at the first and second frequencies may always be longer than a certain predetermined interval. For example, the interval may be 20 seconds, 30 seconds, 1 minute, 2 minutes, or some other interval.

In some embodiments, the first and second frequencies may be constant as the control module 110 alternates between turning the backlight 120 on and off at the first and second frequencies. In other embodiments, the first and/or second frequency may be changed as the control module 110 alternates between turning the backlight 120 on and off at the first and second frequencies. For example, in some embodiments, the control module 110 may change the first frequency while turning the backlight 120 on and off at the first frequency. In other embodiments, the control module 110 may change the first frequency while turning the backlight 120 on and off at the second frequency.

In some embodiments, the first and second frequencies may be predetermined. Alternately or additionally, the first and second frequencies may be randomly selected from a range of frequencies. For example, the first and second frequencies may be randomly selected from a range of frequencies between 60 and 1000 hertz.

Alternately or additionally, the first and second frequencies may be determined based on recording frequencies of recorders. For example, given a set of known recording frequencies for recording devices, the first and second frequencies may be determined to not be a harmonic frequency of the recording frequencies. For example, if known recording frequencies for recording devices were 24, 30, and 60 hertz, the harmonic frequencies of one or more of the recording devices may be 72, 90, 96, 120, 144, 150, 168, 180, 192, 210, 216, 240, 264, 270 and others frequencies. If the first and second frequencies are harmonic frequencies of a recording device, the quality of a recorded image may not be degraded by the turning the backlight 120 on and off at the first and second frequencies.

Furthermore, the closer that the first and second frequencies are near a harmonic of a recording frequency, the less quality degradation of a recorded image may occur. Accordingly, in some embodiments, the first and second frequencies may be selected within ranges that may achieve more degradation of a recorded image. For example, if recording frequencies of recording devices are 24, 30, and 60 hertz, in some embodiments, frequency ranges that may achieve more recorded image degradation may include frequencies between 100-115, 125-139, 198-205, 221-235, and 245-259 hertz, among others. In some embodiments, the first and second frequencies may be selected within the same ranges. In other embodiments, the first and second frequencies may not be selected within the same ranges. In some embodiments, the first and second frequencies may be randomly selected from the frequency ranges that achieve more recorded image degradation.

In some embodiments, the control module 110 may be enabled and disabled. When enabled, the control module 110 may turn the backlight 120 on and off at the first and second frequencies. When disabled, the control module 110 may allow the backlight 120 to perform normal operations. For example, in some embodiments, the control module 110 may receive a signal indicating that private content, copyrighted content, and/or any content for which recorded image degradation is desired is displaying on the LCD 130. The signal may enable the control module 110 to alternate between turning the backlight 120 on and off at a first frequency and turning the backlight on and off at a second frequency. Alternately or additionally, the control module 110 may make a self-determination based on one or more other factors on whether to be enabled or disabled.

In some embodiments, the backlight 120 may be implemented using light emitting diodes, an electroluminescence panel, cold cathode fluorescent lamps, incandescent lamps, woven fiber optic mesh, warm cathode fluorescent lamps, or other lighting elements. In some embodiments, the backlight 120 may be composed of one or more individual lighting elements. For example, in some embodiments, the backlight 120 may include a plurality of light emitting diodes. In these and other embodiments, all of the plurality of light emitting diodes may be turned on and off together at a first or second frequency by the control module 110.

In some embodiments, the LCD 130 may be part of a display for a desktop computer, laptop computer, television, tablet, video gaming console, smart phone, or other electronic device. In some embodiments, the control module 110 may be implemented using hardware, programmable logic, software, or some combination therefore. In some embodiments, the control module 110 may be part of another module within a system that contains an LCD display. In some embodiments, the control module 110 may be integrated into the backlight 120.

Figure 1B:
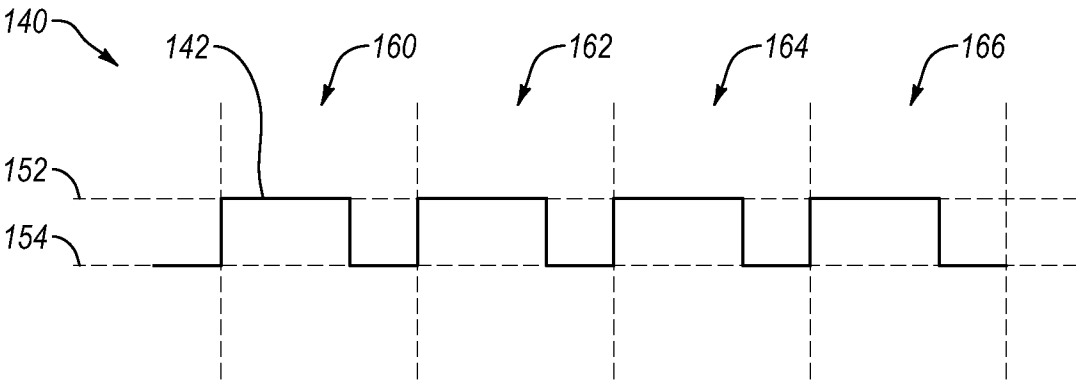
FIG. 1B is a timing diagram 140 of an example signal in the system 100 of FIG. 1A, according to some embodiments.

FIG. 1B is a timing diagram 140 of an example signal 142 in the system 100 of FIG. 1A, according to some embodiments. The timing diagram 140 illustrates periods 160, 162, 164, 166 and the signal 142. In some embodiments, the signal 142 may be produced by the control module 110 and sent to the backlight 120 to control the illumination of the backlight 120 by turning the backlight 120 on and off at a frequency. The signal 142 may alternate between being at a high level 152 and a low level 154. At the high level 152, the signal 142 may turn on the backlight 120. At the low level 154, the signal 142 may turn off the backlight 120. During each period 160, 162, 164, 166, the signal 142 may transition to a high level 152 and then to a low level 154 causing the backlight 120 to turn on and then turn off. A number of periods that occur within a predetermined time determines the frequency at which the signal 142 turns the backlight 120 on and off. For example, if 200 periods occurred within one second, meaning that the backlight 120 was turned on and then off 200 times in one second, the backlight 120 would be turned on and off at a frequency of 200 hertz. In some embodiments, the control module 110 may produce the signal 142 using pulse width modulation. In these and other embodiments, the duty cycle of the signal 142, that is the ratio of the time that the signal 142 is at the high level 152 compared to the low level 154 during a single period, may be adjusted as long as the duty cycle remains less than 100 percent.

In some embodiments, where the control module 110 alternates between turning the backlight 120 on and off at first and second frequencies using first and second signals, the duty cycles of the first and second signals may be substantially equal. If the duty cycles of the first and second frequencies are not substantially equal, the human eye may detect a change in the intensity of the illumination 122 emanating from the LCD 130 when the duty cycle changes.

Figure 2:
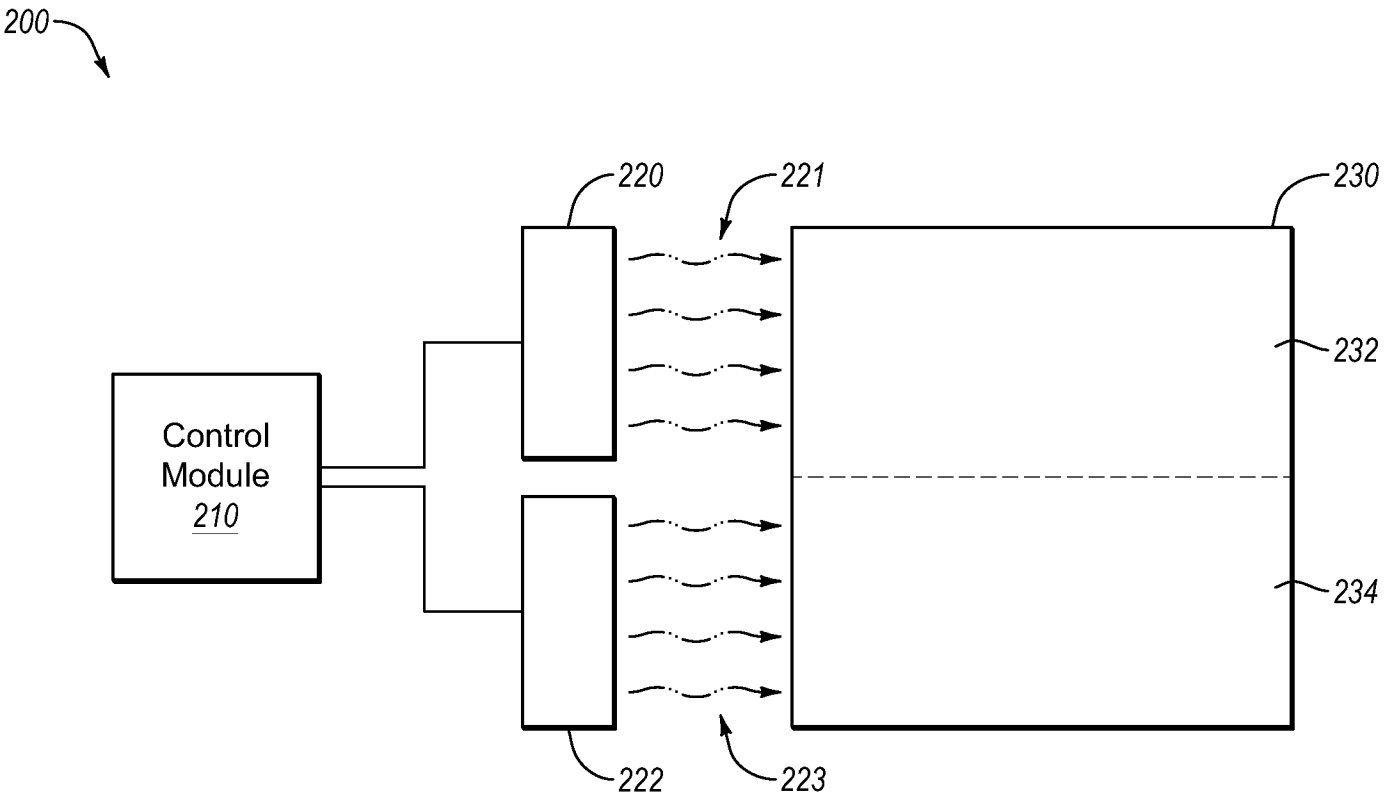
FIG. 2 is a block diagram of an example system 200, according to some embodiments.

FIG. 2 is a block diagram of an example system 200, according to some embodiments. The system 200 includes a control module 210, first and second backlights 220, 222, and an LCD 230. The first backlight 220 may be configured to produce illumination 221 to illuminate a first portion 232 of the LCD 230. The second backlight 222 may be configured to produce illumination 223 to illuminate a second portion 234 of the LCD 230. The control module 210 may be connected to both the first and second backlights 220, 222 and may be configured to control the illumination 221, 223 produced by the respective first and second backlights 220, 222 by turning the first backlight 220 on and off at a first frequency and turning the second backlight 222 on and off at a second frequency. In some embodiments, the second frequency may be the same or different from the first frequency.

In some embodiments, the control module 210 may send a first control signal at a first frequency to the first backlight 220 to turn the first backlight 220 on and off at the first frequency. The control module 210 may also send a second control signal at a second frequency to the second backlight 222 to turn the second backlight 222 on and off at the second frequency. In some embodiments, the first and second signals may be pulse width modulated signals. Alternately or additionally, the first and second signals may have the same or similar duty cycles.

In some embodiments, the control module 210 may change the frequency of either control signal, and thereby change the frequency at which the backlights 220, 222 are turned on and off. The control module 210 may change the frequency of either control signal periodically or randomly. In some embodiments, the control module 210 may wait a minimum time interval between changing the frequency of either of the control signals. For example, in some embodiments, the minimum time interval may be 20 seconds, 30 seconds, 1 minute, 2 minutes, or some other interval. In some embodiments, the frequencies of the control signals may be changed at the same time or at different times. The control module 210 may change the frequencies of the control signals to predetermined frequencies or random frequencies from a range of frequencies or multiple ranges of frequencies. For example, in some embodiments, the control module 210 may randomly select frequencies from ranges of frequencies that achieve more degradation of a recorded image as discussed above.

In some embodiments, the control module 210 may control the first and second backlights 220, 222 so that only one of the backlights 220, 222 is being turned on and off at one time while the other of the backlights 220, 222 is not configured to degrade recorded images. For example, the control module 210 may turn the first backlight 220 on and off at a first frequency during a first period while the second backlight 222 is not being turned on and off at a second frequency. In a second period, the control module may turn the second backlight 222 on and off at a second frequency while the first backlight 220 is not being turned on and off at the first frequency. In these and other embodiments, only a portion of recorded images may be degraded at any one time.

In some embodiments, the backlights 220, 222 may be implemented using light emitting diodes, an electroluminescence panel, cold cathode fluorescent lamps, incandescent lamps, woven fiber optic mesh, warm cathode fluorescent lamps, or other lighting elements. In some embodiments, the backlights 220, 222 may be implemented using the same or different lighting elements. Furthermore, in some embodiments, each backlight 220, 222 may be composed of one or more individual lighting elements.

In some embodiments, the system 200 may include a third backlight that may produce illumination that illuminates a third portion of the LCD 230. The control module 210 may be configured to control the illumination produced by the third backlight by turning the third backlight on and off at a third frequency. Furthermore, in some embodiments, each individual lighting element that produces illumination for the LCD 230 may be controlled by the control module 210 or some other module to turn each of the individual lighting elements on and off at the same, different, or some combination of frequencies.

Figure 3:
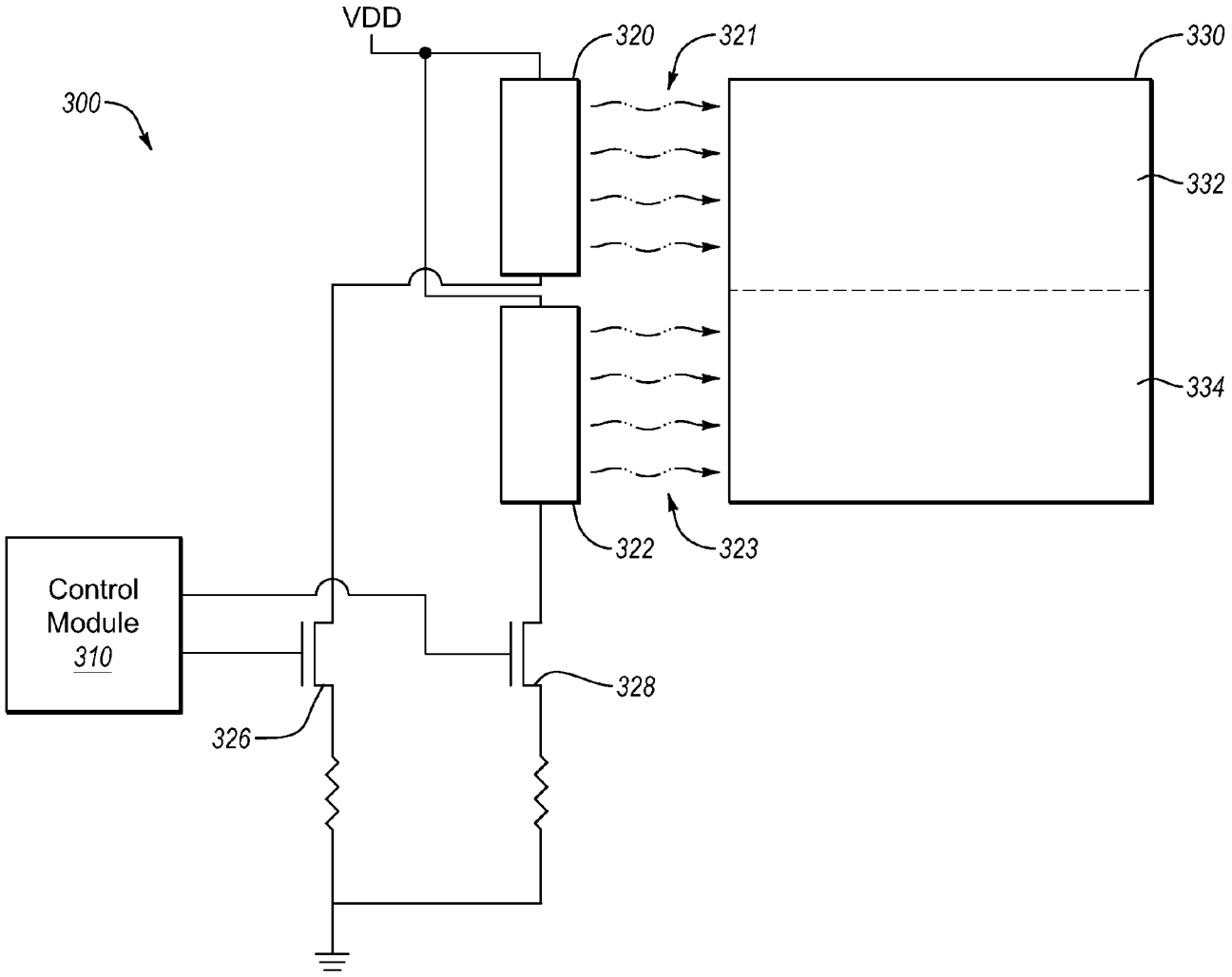
FIG. 3 is a block diagram of an example system 300, according to some embodiments.

FIG. 3 is a block diagram of an example system 300, according to some embodiments. The system 300 includes a control module 310, first and second backlights 320, 322, and an LCD 330. The first backlight 320 may be multiple light emitting diodes configured to produce illumination 321 that illuminates a first portion 332 of the LCD 330. The first backlight 320 may produce the illumination 321 when a first switch 326 is closed. In the closed position, the first switch 326 may couple the first backlight 320 between a voltage VDD and ground allowing a current to flow through the first backlight 320 causing the light emitting diodes in the first backlight 320 to produce illumination 321. When the first switch 326 is open, no current may flow through the first backlight 320 and thus no illumination 321 is produced.

The second backlight 322 may be multiple light emitting diodes configured to produce illumination 323 that illuminates a second portion 334 of the LCD 330. The second backlight 322 may produce the illumination 323 when a second switch 328 is closed. In the closed position, the second switch 328 may couple the second backlight 322 between VDD and ground allowing a current to flow through the second backlight 322 causing the light emitting diodes in the second backlight 322 to produce illumination 323. When the second switch 328 is open, no current may flow through the second backlight 322 and thus no illumination 323 is produced. In some embodiments, the first and second switches 326, 328 may be transistors or some other type of switches or switching circuits.

The control module 310 may control the operation of both the first and second switches 326, 328. By turning the first and second switches 326, 328 on and off at respective first and second frequencies, the control module 310 may turn the first and second backlights 320, 322 on and off at respective first and second frequencies. In some embodiments, the control module 310 may control the operation of the first and second switches 326, 328 by providing each of the switches 326, 328 with a pulse width modulated signal. In these and other embodiments, the control module 310 may be a pulse width modulation signal generator with two outputs. In some embodiments, the control module 310 may be configured to vary and/or determine the frequencies of the control signals as discussed above with respect to FIGS. 1A and 2.

Figure 4:
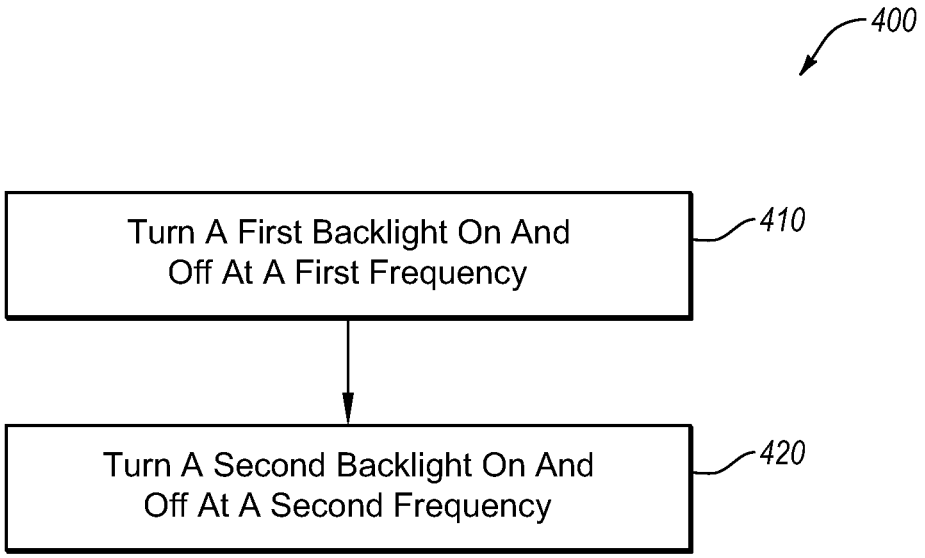
FIG. 4 is a flow chart of an example method 400, according to some embodiments.

FIG. 4 is a flow chart of an example method 400, according to some embodiments. The method 400 may be performed, for example, by the system 200 described with respect with FIG. 2. The flow charts described herein do not necessarily imply a fixed order to the actions, and embodiments may be performed in any order that is practicable. Note that any of the methods described herein may be performed by hardware, software (including microcode), or a combination of hardware and software. For example, a storage medium may store thereon instructions that when executed by a machine result in performance according to any of the embodiments described herein.

At 410, a first backlight may be turned on and off at a first frequency. The first backlight may illuminate a first portion of a LCD. At 420, a second backlight may be turned on and off at a second frequency. The second backlight may illuminate a second portion of the LCD. In some embodiments, the first and second frequencies are different.

In some embodiments, the method 400 may further include changing the first frequency at which the first backlight is turned on and off. Alternately of additionally, the method 400 may further include changing the second frequency at which the second backlight is turned on and off. The first and second frequencies may be changed to predetermined frequencies, random frequencies or some combination thereof. In some embodiments, the first and second frequencies may be changed to random frequencies selected from a range of frequencies, such as an approximate range between 60 and 1000 hertz. Alternately or additionally, the first and second frequencies may be changed to random frequencies selected from multiple ranges of frequencies. In some embodiments, the multiple ranges of frequencies may depend on the recording frequencies and harmonic frequencies of a recording device that may record images from the LCD.

In some embodiments, one of the first and second frequencies may be changed while the other is not. In some embodiments, the first and second frequencies may be changed at random intervals or set intervals. In some embodiments, the random or set intervals may be longer than 1 minute.

In some embodiments, only the first backlight may be turned on and off at a first frequency during a first period and only the second backlight may be turned on and off at a second frequency during a second period. In these and other embodiments, the first period may be same, longer, or shorter than the second period. In some embodiments, the method may further include turning on and off a third backlight at a third frequency that is different from the first and second frequencies. The third backlight may illuminate a third portion of the LCD.

In some embodiments, the method 400 may be performed to degrade image quality of images recorded from the LCD by a recording device.

Figure 5:
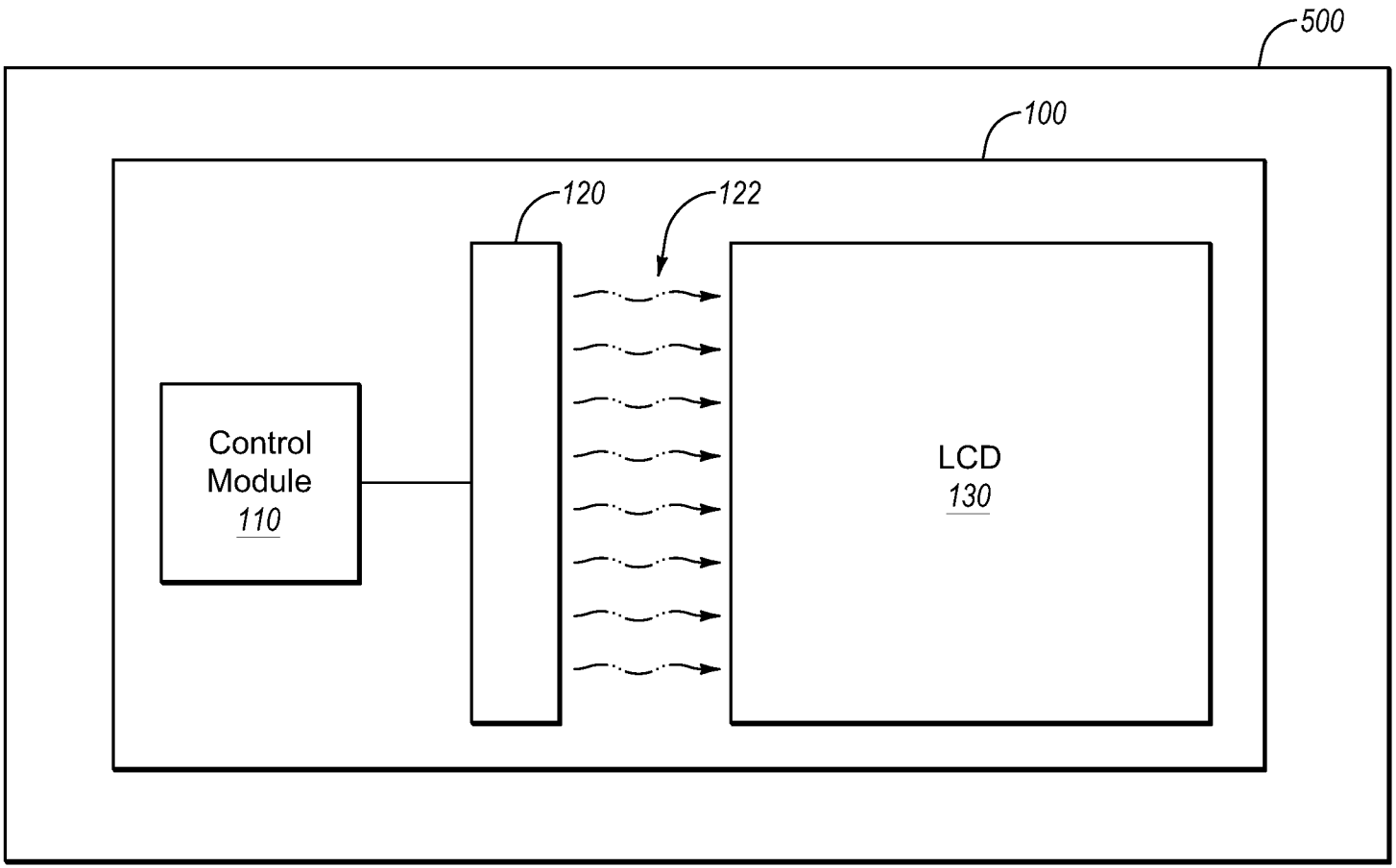
FIG. 5 is a block diagram of an example system 500 that incorporates the example system 100 of FIG. 1A, according to some embodiments.

FIG. 5 is a block diagram of an example system 500 that incorporates the example system 100 of FIG. 1A, according to some embodiments. The system 500 may include system 100 and one or more other modules. For example, in some embodiments, the system 500 may be a desktop monitor, laptop computer, television, tablet, video gaming console, smart phone, or other electronic device. The LCD 130 may be a display within the system 500 and may receive signals from one or more modules within the system 500. The control module 110 may be a separate module or integrated into one or more modules within the system 500. According to some embodiments, the control module 110 includes a battery to power the LCD 130.

Although particular system, hardware, and interface configurations have been described herein, embodiments may be performed with any other types of system, hardware, and/or interface configurations. Similarly, although specific methods have been described, any number of other types of methods might be performed in connection with embodiments described here.

The several embodiments described herein are solely for the purpose of illustration. Persons skilled in the art will recognize from this description that other embodiments may be practiced with modifications and alterations limited only by the claims.

What is claimed is:

1. An apparatus to degrade a portion of recorded images of copyrighted material, the apparatus comprising:

a control module to degrade only a portion of recorded images at a time by selectively controlling the illumination of a first backlight to illuminate a first portion of a liquid crystal display and a second backlight to illuminate a second portion of the liquid crystal display, wherein in an enabled state, the control module is configured to turn the first backlight on and off at a first frequency during a first period while the second backlight is not being turned on and off at a second frequency and turn the second backlight on and off at a second frequency during a second period while the first backlight is not being turned on and off at the first frequency where the first frequency is a non-harmonic frequency associated with known recording frequencies of recording devices and the second frequency is a non-harmonic frequency associated with known recording frequencies of recording devices, the second frequency being different than the first frequency, wherein the control module is in the enabled state in response to receiving an indication that recorded image degradation is desired.

2. The apparatus of claim 1, wherein the first non-harmonic frequency and second non-harmonic frequency are in a frequency ranges between 100-115 hertz, 125-139 hertz, 198-205 hertz, 221-235 hertz and 245-259 hertz.

3. The apparatus of claim 1, wherein the control module is to use a first pulse width modulated signal at the first frequency to turn the backlight on and off at the first frequency and a second pulse width modulated signal at the second frequency to turn the backlight on and off at the second frequency.

4. The apparatus of claim 3, wherein the duty cycle of the first pulse width modulated signal is equal to the duty cycle of the second pulse width modulated signal.

5. The apparatus of claim 1, wherein the control module is to turn the backlight on and off at a first frequency for intervals that are greater than one minute and turn the backlight on and off at a second frequency for intervals greater than one minute.

6. An apparatus, comprising:

a first backlight configured to illuminate a first portion of a liquid crystal display;

a second backlight configured to illuminate a second portion of the liquid crystal display; and a control module to degrade only a portion of recorded images at a time by selectively controlling the illumination of the first and second backlights, wherein in an enabled state, the control module is configured to turn the first backlight on and off at a first frequency during a first period while the second backlight is not being turned on and off at a second frequency and turn the second backlight on and off at a second frequency during a second period while the first backlight is not being turned on and off at the first frequency, where the first frequency is a non-harmonic frequency associated with known recording frequencies of recording devices and the second frequency is a non-harmonic frequency associated with known recording frequencies of recording devices, the second frequency being different than the first frequency, wherein the control module is in the enabled state in response to receiving an indication that recorded image degradation is desired.

7. The apparatus of claim 6, wherein the control module is in the enabled state after receiving an indication that private content, copyrighted content, or any content for which recorded image degradation is to be displayed.

8. The apparatus of claim 6, wherein the control module is to produce a first pulse width modulated signal at the first frequency to turn the first backlight on and off at the first frequency and a second pulse width modulated signal at the second frequency to turn the second backlight on and off at the second frequency.

9. The apparatus of claim 8, wherein the duty cycle of the first pulse width modulated signal is equal to the duty cycle of the second pulse width modulated signal.

10. The apparatus of claim 6, wherein the control module is to change the first frequency to a third frequency.

11. The apparatus of claim 10, wherein the third frequency is to be random chosen.

12. The apparatus of claim 10, wherein the control module is to randomly change the first frequency to the third frequency.

13. The apparatus of claim 6, further comprising a third backlight configured to illuminate a third portion of the liquid crystal display.

14. The apparatus of claim 13, wherein the control module is to control the illumination of the third backlight and is further configured to turn the third backlight on and off at a third frequency.

15. An electronic device that comprises the apparatus of claim 6.

16. A method, comprising:

in response to receiving an indication that recorded image degradation is desired, turning a first backlight on and off at a first frequency associated with known recording frequencies of recording devices, the first backlight illuminating a first portion of a liquid crystal display so that only a portion of recorded images are degraded at a time; and turning a second backlight on and off at a second frequency associated with known recording frequencies of recording devices, the second backlight illuminating a second portion of the liquid crystal display, the second frequency being different than the first frequency where the first backlight is turned on and off at the first frequency during a first period while the second backlight is not being turned on and off at the second frequency and the second backlight is turned on and off at the second frequency during the second period while the first backlight is not being turned on and off at the first frequency.

17. The method of claim 16, further comprising changing the first frequency at which the first backlight is turned on and off.

18. The method of claim 17, wherein the first frequency is changed at a random interval and to a random frequency.

19. The method of claim 17, further comprising changing the second frequency at which the second backlight is turned on and off.

20. The method of claim 19, wherein the second frequency is changed at a random interval and to a random frequency.

21. The method of claim 16, wherein the first backlight is turned on and off at the first frequency during a first period and the second backlight is not turned on and off at the second frequency during the first period and wherein the first backlight is not turned on and off at the first frequency during a second period and the second backlight is turned on and off at the second frequency during the second period.

22. An apparatus, comprising:

a battery;

a first backlight configured to use power from the battery to illuminate a first portion of the liquid crystal display;

a second backlight configured to use power from the battery to illuminate a second portion of the liquid crystal display; and a control module to selectively control the illumination of the first and second backlights, wherein in an enabled state, the control module is configured to turn the first backlight on and off at a first frequency during a first period while the second backlight is not being turned on and off at a second frequency and turn the second backlight on and off at a second frequency during a second period while the first backlight is not being turned on and off at the first frequency, where the first frequency is a non-harmonic frequency associated with known recording frequencies of recording devices and the second frequency is a non-harmonic frequency associated with known recording frequencies of recording devices, the second frequency being different than the first frequency, wherein the control module is in the enabled state in response to receiving an indication that recorded image degradation is desired.

23. The system of claim 22, wherein the control module is in the enabled state after receiving an indication that private content or copyrighted content is to be displayed.

24. The system of claim 22, wherein the control module is to use a first pulse width modulated signal at the first frequency to turn the backlight on and off at the first frequency and a second pulse width modulated signal at the second frequency to turn the backlight on and off at the second frequency.

25. The system of claim 24, wherein the duty cycle of the first pulse width modulated signal is equal to the duty cycle of the second pulse width modulated signal.

26. The system of claim 22, wherein the control module is to turn the backlight on and off at a first frequency for intervals that are greater than one minute and turn the backlight on and off at a second frequency for intervals greater than one minute.

* * * * *